US011120744B2

(12) United States Patent
Kim et al.

(10) Patent No.: US 11,120,744 B2
(45) Date of Patent: Sep. 14, 2021

(54) DISPLAY DEVICE AND METHOD OF DRIVING THE SAME

(71) Applicant: SAMSUNG DISPLAY CO., LTD., Yongin-si (KR)

(72) Inventors: Sunghwan Kim, Yongin-si (KR); Chulkyu Kang, Yongin-si (KR); Daehyun Kim, Yongin-si (KR); Soohee Oh, Yongin-si (KR); Dongsun Lee, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/551,006

(22) Filed: Aug. 26, 2019

(65) Prior Publication Data

US 2020/0168159 A1 May 28, 2020

(30) Foreign Application Priority Data

Nov. 23, 2018 (KR) ..... 10-2018-0146646

(51) Int. Cl.

| | |
|---|---|
| ***G09G 3/3275*** | (2016.01) |
| ***G09G 3/3266*** | (2016.01) |
| ***G09G 3/3258*** | (2016.01) |
| ***G09G 3/3225*** | (2016.01) |

(52) U.S. Cl.

CPC ..... *G09G 3/3266* (2013.01); *G09G 3/3225* (2013.01); *G09G 3/3275* (2013.01); *G09G 2300/0452* (2013.01); *G09G 2310/0202* (2013.01)

(58) Field of Classification Search

None

See application file for complete search history.

(56) References Cited

U.S. PATENT DOCUMENTS

| | | | | |
|---|---|---|---|---|
| 9,934,719 | B2 | 4/2018 | Wang et al. | |
| 2012/0306825 | A1 | 12/2012 | Cho | |
| 2014/0198135 | A1 | 7/2014 | Eom et al. | |
| 2017/0263188 | A1 | 9/2017 | Na et al. | |
| 2017/0309228 | A1* | 10/2017 | Matsueda | H01L 27/3262 |
| 2018/0122304 | A1* | 5/2018 | Kim | G09G 3/3266 |

FOREIGN PATENT DOCUMENTS

| | | | |
|---|---|---|---|
| KR | 10-0758278 | B1 | 9/2007 |
| KR | 10-2012-0133151 | A | 12/2012 |
| KR | 10-1227139 | B1 | 1/2013 |
| KR | 10-2014-0093091 | A | 7/2014 |
| KR | 10-2017-0079769 | A | 7/2017 |
| KR | 10-2017-0105683 | A | 9/2017 |

OTHER PUBLICATIONS

Fujii, et al., "4032ppi High-Resolution OLED Microdisplay," SID 2018 DIGEST, pp. 613-616.

* cited by examiner

*Primary Examiner* — Carl Adams

(74) *Attorney, Agent, or Firm* — Kile Park Reed & Houtteman PLLC

(57) ABSTRACT

A display device includes a pixel circuit including a first pixel and a second pixel. The first pixel arranged in a first row and the second pixel arranged in a second row are commonly connected to one scan line, the number of the scan lines required by the display device may be reduced to half. An active period of the first selection signal does not overlap an active period of the second selection signal. A scan on time of the scan signal overlaps one of the active period of the first selection signal and the active period of the second selection signal.

15 Claims, 8 Drawing Sheets

DISPLAY DEVICE AND METHOD OF DRIVING THE SAME

CROSS-REFERENCE TO RELATED APPLICATION

Korean Patent Application No. 10-2018-0146646, filed on Nov. 23, 2018, in the Korean Intellectual Property Office, and entitled: "Display Device and Method of Driving the Same," is incorporated by reference herein in its entirety.

BACKGROUND

1. Field

The present disclosure relates to a display device and a method of driving the same. More particularly, the present disclosure relates to a display device capable of reducing an area of a non-display area and a method of driving the same.

2. Description of the Related Art

Among display devices, an organic light emitting display device displays an image using an organic light emitting diode that generates a light from electron-hole recombination. The organic light emitting display device has advantages, such as fast response speed and low power consumption.

The organic light emitting display device includes data lines, scan lines, and pixels connected to the data lines and the scan lines. Each pixel includes the organic light emitting diode and a circuit unit that controls an amount of current flowing through the organic light emitting diode. The circuit unit controls the amount of current flowing from a first driving voltage to a second driving voltage via the organic light emitting diode in response to a data signal. In this case, a light having a predetermined brightness is generated corresponding to the amount of current flowing through the organic light emitting diode.

The display device includes a display area in which the pixels are arranged and a non-display area in which a driving circuit is arranged. In recent years, research continues to reduce the area of the non-display area.

SUMMARY

Embodiments provide a display device including a pixel circuit that includes a first pixel connected to a first data line and a scan line and a second pixel connected to a second data line and the scan line, a scan driving circuit outputting a scan signal to drive the scan line, a data driving circuit outputting a data signal, a data output circuit applying the data signal to the first data line and the second data line in response to the first selection signal and the second selection signal, and a driving controller controlling the scan driving circuit and the data driving circuit and outputting the first selection signal and the second selection signal. An active period of the first selection signal does not overlap an active period of the second selection signal, and a scan on time of the scan signal overlaps one of the active period of the first selection signal and the active period of the second selection signal.

The scan line extends in a first direction, the first data line and the second data line extend in a second direction crossing the first direction and are arranged spaced apart from each other, and the first pixel and the second pixel are sequentially arranged in the second direction.

The first data line is arranged adjacent to a first side of the first pixel and the second pixel, and the second data line is arranged adjacent to a second side of the first pixel and the second pixel.

The first pixel arranged in a first column is a red pixel, a second pixel arranged in the first column is a blue pixel, and each of the first and second pixels arranged in a second column adjacent to the first column is a green pixel.

When a first frame starts, the second selection signal is activated after the first selection signal is activated, and the scan on time of the scan signal overlaps the active period of the second selection signal.

When a second frame continuous from the first frame starts, the first selection signal is activated after the second selection signal is activated, and the scan on time of the scan signal overlaps the active period of the first selection signal.

The scan on time of the scan signal is substantially equal to one horizontal period.

The active period of the first selection signal is shorter than an inactive period of the first selection signal.

The active period of the second selection signal is shorter than an inactive period of the second selection signal.

The data output circuit includes a first switching transistor applying the data signal to the first data line in response to the first selection signal and a second switching transistor applying the data signal to the second data line in response to the second selection signal.

Embodiments provide a display device including a pixel circuit that includes a first pixel connected to a first data line and a scan line and a second pixel connected to a second data line and the scan line, a scan driving circuit outputting a scan signal to drive the scan line, a data driving circuit outputting a data signal, a data output circuit applying the data signal to the first data line in response to a first selection signal and applying the data signal to the second data line in response to the second selection signal, and a driving controller controlling the scan driving circuit and the data driving circuit and outputting the first selection signal and the second selection signal. The driving controller sequentially activates the first selection signal and the second selection signal and activates the scan signal when the second selection signal is activated.

The scan line extends in a first direction, the first data line and the second data line extend in a second direction crossing the first direction and are arranged spaced apart from each other, and the first pixel and the second pixel are sequentially arranged in the second direction.

The first data line is arranged adjacent to a first side of the first pixel and the second pixel, and the second data line is arranged adjacent to a second side of the first pixel and the second pixel.

The first pixel arranged in a first column is a red pixel, a second pixel arranged in the first column is a blue pixel, and each of the first and second pixels arranged in a second column adjacent to the first column is a green pixel.

A scan on time of the scan signal is substantially equal to one horizontal period.

The data output circuit includes a first switching transistor applying the data signal to the first data line in response to the first selection signal and a second switching transistor applying the data signal to the second data line in response to the second selection signal.

Embodiments provide a method of driving a display device, which includes a first pixel connected to a first data line and a scan line and a second pixel connected to a second data line and the scan line, including outputting a first data signal to the first data line in response to a first selection signal, outputting a second data signal to the second data line in response to a second selection signal, and applying a scan signal to the scan line. An active period of the first selection signal does not overlap with an active period of the second selection signal, and a scan on time of the scan signal overlaps one of the active period of the first selection signal and the active period of the second selection signal.

The scan line extends in a first direction, the first data line and the second data line extend in a second direction crossing the first direction and are arranged spaced apart from each other, and the first pixel and the second pixel are sequentially arranged in the second direction.

When a first frame starts, the second selection signal is activated after the first selection signal is activated, and the scan on time of the scan signal overlaps the active period of the second selection signal.

When a second frame continuous from the first frame starts, the first selection signal is activated after the second selection signal is activated, and the scan on time of the scan signal overlaps the active period of the first selection signal.

The scan on time of the scan signal is substantially equal to one horizontal period.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
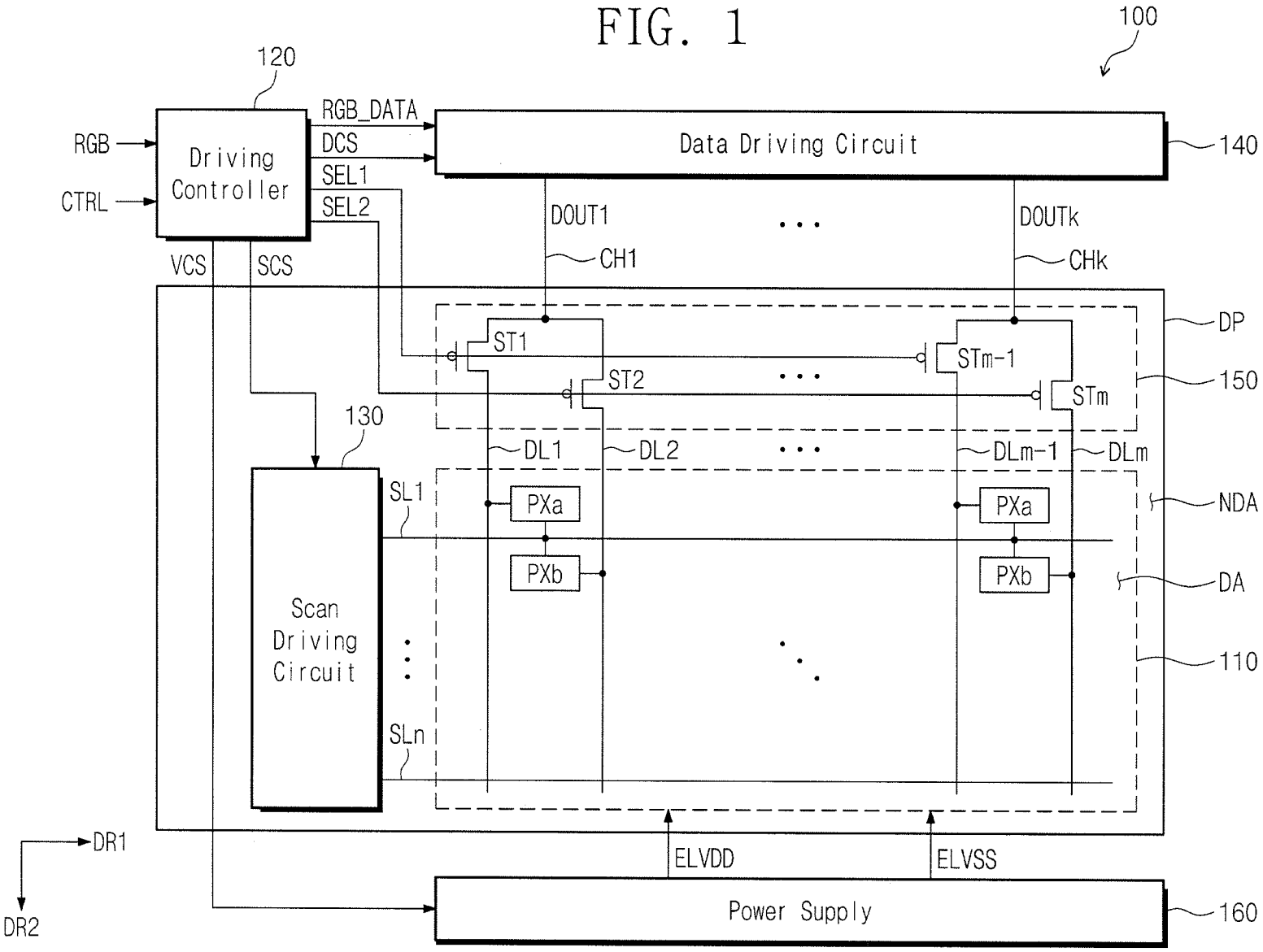
FIG. 1 illustrates a plan view of a display device according to an exemplary embodiment of the present disclosure.

It will be understood that when an element or layer is referred to as being "on". "connected to" or "coupled to" another element or layer, it can be directly on, connected or coupled to the other element or layer or intervening elements or layers may be present.

Like numerals refer to like elements throughout. In the drawings, the thickness of layers, films, and regions are exaggerated for clarity.

As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure. As used herein, the singular forms, "a", "an" and "the" are intended to include the plural forms as well, unless the context clearly indicates otherwise.

Spatially relative terms, such as "beneath", "below", "lower", "above", "upper" and the like, may be used herein for ease of description to describe one element or feature's relationship to another element(s) or feature(s) as illustrated in the figures.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Hereinafter, the present disclosure will be explained in detail with reference to the accompanying drawings.

FIG. 1 is a plan view showing a display device 100 according to an exemplary embodiment of the present disclosure. Referring to FIG. 1, the display device 100 includes a pixel circuit 110, a driving controller 120, a scan driving circuit 130, a data driving circuit 140, a data output circuit 150, and a power supply 160.

The pixel circuit 110, the scan driving circuit 130, and the data output circuit 150 may be on a display substrate DP. According to an implementation, the data output circuit 150 may be arranged in the data driving circuit 140. In the present exemplary embodiment, the scan driving circuit 130 may be implemented by an amorphous silicon gate (ASG) using an amorphous silicon thin film transistor (a-Si TFT), an oxide semiconductor, a crystalline semiconductor, a polycrystalline semiconductor, and the like, and may be integrated in a predetermined area of the display substrate DP. According to an implementation, the scan driving circuit 130 may be a tape carrier package (TCP), a chip-on-film (COF), and the like.

The display substrate DP may include various display panels. e.g., a liquid crystal display panel, an organic light emitting display panel, an electrophoretic display panel, an electrowetting display panel, and the like. When the display substrate DP includes the liquid crystal display panel, the display device 100 may further include a backlight unit. In the present exemplary embodiment, the organic light emitting display panel will be described as the display substrate DP.

When viewed in a plan view, the display substrate DP includes a display area DA in which a plurality of pixels is arranged and a non-display area NDA surrounding the display area DA. The pixel circuit 110 is in the display area DA, and the scan driving circuit 130 and the data driving circuit 140 are in the non-display area NDA.

The pixel circuit 110 includes a plurality of scan lines SL1 to SLn extending in a first direction DR1, a plurality of data lines DL1 to DLm extending in a second direction, and a plurality of pixels PXa and PXb connected to the scan lines SL1 to SLn and the data lines DL1 to DLm. In the present exemplary embodiment, each of "m" and "n" is a positive integer. FIG. 1 shows only some scan lines among the scan lines SL1 to SLn and some data lines among the data lines DL1 to DLm.

FIG. 1 shows only some pixels among the pixels PXa and PXb. Each of the pixels PXa and PXb is connected to a corresponding scan line among the scan lines SL1 to SLn and a corresponding data line among the data lines DL1 to DLm.

The scan lines SL1 to SLn extend in the first direction DR1 and are arranged spaced apart from each other in the second direction DR2. The data lines DL1 to DLm extend in the second direction DR2 and are arranged spaced apart from each other in the first direction DR1.

Each of the pixels PXa and PXb includes an organic light emitting diode and a pixel circuit unit that controls a light emission of the organic light emitting diode. The circuit unit includes a plurality of transistors and a capacitor. At least one of the scan driving circuit 130 and the data driving circuit 140 may include transistors formed through the same processes as the pixel circuit unit.

The pixels PXa and PXb may be grouped into a plurality of groups. The pixels PXa and PXb may display one of primary colors to produce a full color display. The primary colors may include red, green, blue, and white colors; yellow, cyan, and magenta colors; and may further include white.

In the present exemplary embodiment shown in FIG. 1, a first pixel PXa is connected to each of odd-numbered data lines DL1, . . . , DLm-1, and a second pixel PXb is connected to each of even-numbered data lines DL2, . . . , DLm. Two pixels adjacent to each other in the second direction DR2, i.e., the first and second pixels PXa and PXb are commonly connected to one scan line. The connection relation between plural first and second pixels PXa and PXb, the data lines DL1 to DLm, and the scan lines SL1 to SLn will be described later in detail.

The driving controller 120 receives image signals RGB and control signals CTRL from an external graphic controller (or a host processor, not shown). The controls signals CTRL include a vertical synchronization signal, a horizontal synchronization signal, a data enable signal, and clock signals.

The driving controller 120 converts a data format of the image signals RGB to generate image data signals RGB_DATA. The driving controller 120 outputs a scan control signal SCS, a data control signal DCS, a voltage control signal VCS, a first selection signal SEL1, and a second signal SEL2.

The scan driving circuit 130 receives the scan control signal SCS from the driving controller 120. The scan driving circuit 130 generates a plurality of scan signals and sequentially outputs the scan signals to the scan lines SL1 to SLn. The scan driving circuit 130 may further apply a plurality of light emission control signals to the pixel circuit 110 in response to the scan control signal SCS. According to another embodiment, the display device 100 may separately include a light emission driving circuit that outputs the light emission control signals.

In FIG. 1, the plural scan signals are output from one scan driving circuit 130. According to an implementation, plural scan driving circuits may divide and output the plural scan signals.

The data driving circuit 140 receives the data control signal DCS and the image data signals RGB_DATA. The data driving circuit 140 converts the image data signals RGB_DATA to data signals DOUT1 to DOUTk and outputs the data signals DOUT1 to DOUTk to the data lines DL1 to DLm. The data signals DOUT1 to DOUTk are analog voltages corresponding to grayscale values of the image data signals RGB_DATA. In the present exemplary embodiment. "k" is a positive integer, and "k" is equal to m/2.

The data output circuit 150 selectively and electrically connects a plurality of channels CH1 to CHk of the data driving circuit 140 to the data lines DL1 to DLm in response to the first and second selection signals SEL1 and SEL2. For instance, the data output circuit 150 electrically connects the channel CH1 to one of the data lines DL1 and DL2 in response to the first selection signal SEL1 and electrically connects the channel CHk to one of the data lines DLm-1 and DLm in response to the second selection signal SEL2.

In the exemplary embodiment, among the data lines, odd-numbered data lines DL1, DL3, . . . , DLm-1 connected to the first pixels PXa are referred to as "first data lines", and even-numbered data lines DL2, DL4, . . . , DLm connected to the second pixels PXb are referred to as "second data lines".

For example, the data output circuit 150 applies the data signals DOUT1 to DOUTk to the first data lines DL1, DL3, . . . , DLm-1 in an active period of the first selection signal SEL1 and applies the data signals DOUT1 to DOUTk to the second data lines DL2, DL4, . . . , DLm in an active period of the second selection signal SEL2.

The data output circuit 150 is in a predetermined area of the display substrate DP adjacent to the data driving circuit 140 or is on a separate circuit board.

The data output circuit 150 includes a plurality of switching transistors ST1 to STm respectively corresponding to the data lines DL1 to DLm. Each of the switching transistors ST1 to STm includes a first electrode connected to a corresponding channel among the channels CH1 to CHk, a second electrode connected to a corresponding data line among the data lines DL1 to DLm. and a gate electrode connected to a corresponding selection signal among the first and second selection signals SEL1 and SEL2.

Among the switching transistors ST1 to STm, odd-numbered transistors are respectively connected to the first data lines DL1, DL3, . . . , DLm-1 and operate in response to the first selection signal SEL1. Among the switching transistors ST1 to STm, even-numbered transistors are respectively connected to the second data lines DL2, DL4, . . . , DLm and operate in response to the second selection signal SEL2.

For instance, the data signal D1 output from the data driving circuit 140 through the channel CH1 is applied to one of the data lines DL1 and DL2 through the data output circuit 150, and the data signal Dm is applied to one of the data lines DLm-1 and DLm through the data output circuit 150. The data driving circuit 140 may drive two data lines using the data signal output through one channel.

The power supply 160 receives the voltage control signal VCS from the driving controller 120 and applies a first driving voltage ELVDD and a second driving voltage ELVSS to the pixel circuit 110. The power supply 160 generates various voltages to the scan driving circuit 130 and the data driving circuit 140 in addition to the pixel circuit 110. For example, the power supply 160 may generate a scan on voltage and a scan off voltage for the operation of the scan driving circuit 130.

Figure 2:
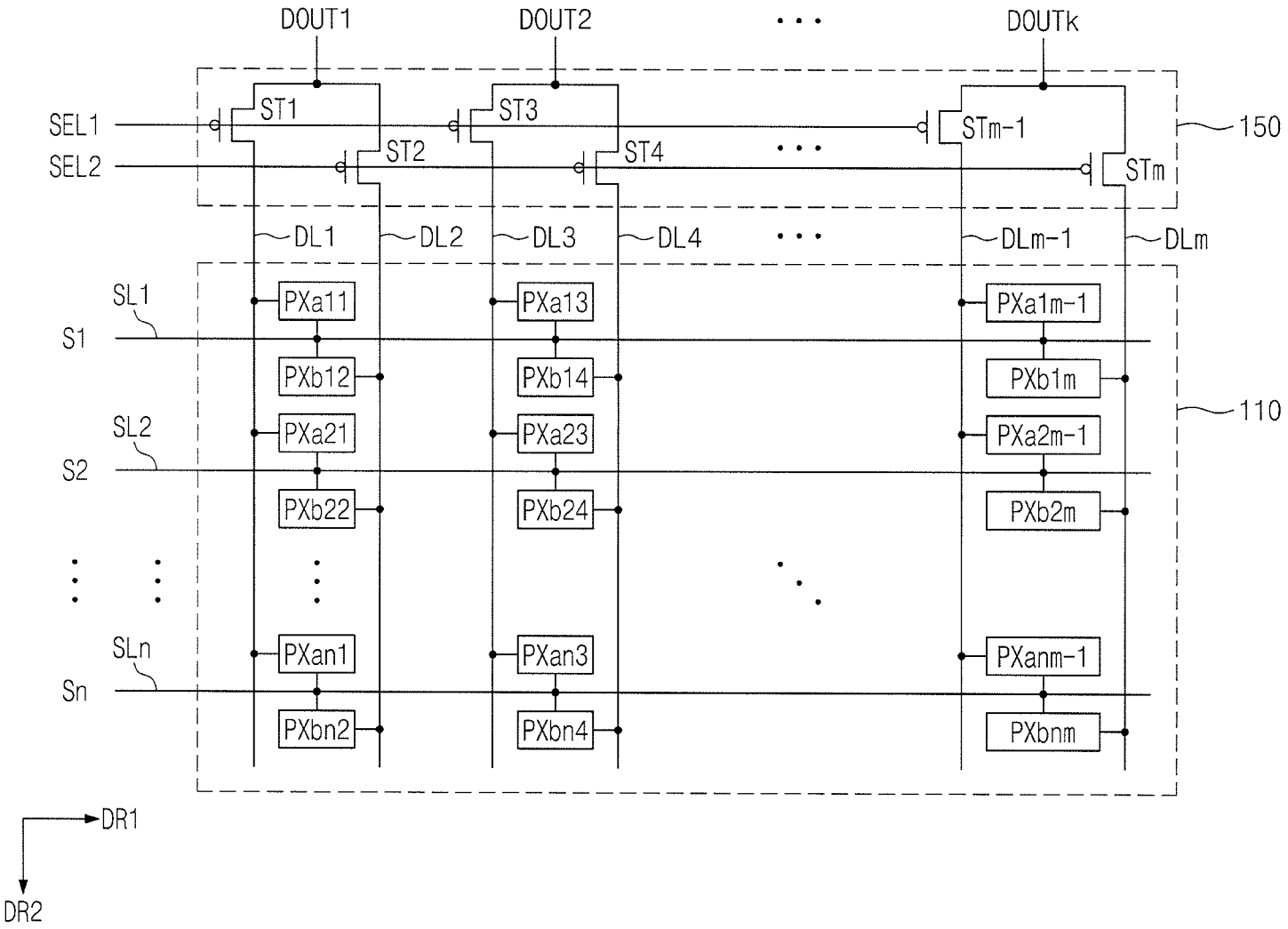
FIG. 2 illustrates a circuit diagram showing a data output circuit and a pixel circuit shown in FIG. 1.

FIG. 2 is a circuit diagram showing the data output circuit 150 and the pixel circuit 110 shown in FIG. 1. Referring to FIG. 2, the pixel circuit 110 includes a plurality of pixels PXa11 to PXbnm. In FIG. 1, the pixels of the pixel circuit 110 are shown as the first pixels PXa connected to the first data lines and the second pixels PXb connected to the second data lines. However, in FIG. 2, reference numerals of the first and second pixels of the pixel circuit 10 are represented differently to distinguish the data line and the scan line, which are connected to each pixel. For example, the first pixel PXa11 is connected to the scan line SL1 and the first data line DL1, and the second pixel PXb12 is connected to the scan line SL1 and the second data line DL2.

Among the pixels PXa11 to PXbnm, first pixels PXa11 to PXanm-1 are connected to the odd-numbered data lines, i.e., the first data lines DL1, DL3, . . . , DLm-1. Among the pixels PXa11 to PXbnm, second pixels PXb12 to PXnm are connected to the even-numbered data lines, i.e., the second data lines DL2, DL4, . . . , DLm.

The first pixels and the second pixels adjacent to each other in the second direction DR2 are commonly connected to one scan line. For example, the first pixels PXa11 to PXa1*m*-1 and the second pixels PXb12 to PXb1*m* are connected to the scan line SL1. The first pixels PXa21 to PXa2*m*-1 and the second pixels PXb22 to PXb2*m* are connected to the scan line SL2. The first pixels PXan1 to PXanm-1 and the second pixels PXbn2 to PXbnm are connected to the scan line SLn, and so forth.

Figure 3:
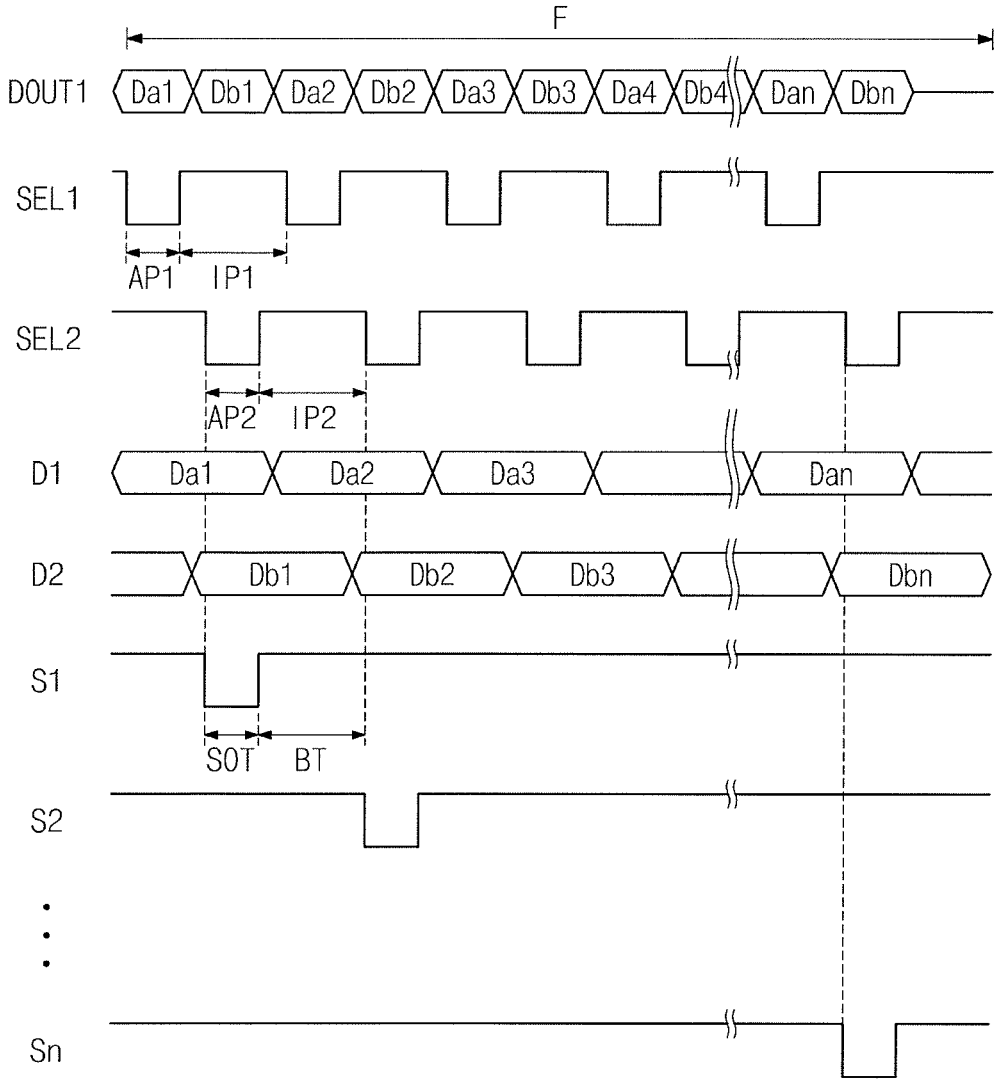
FIG. 3 illustrates a timing diagram showing a method of driving a display device according to an exemplary embodiment of the present disclosure.

FIG. 3 is a timing diagram showing a method of driving the display device according to an exemplary embodiment of the present disclosure. Referring to FIG. 3, the data driving circuit 140 outputs the data signals DOUT1 to DOUTk.

The driving controller 120 outputs the first selection signal SEL1 and the second selection signal SEL2. In the exemplary embodiment, the first selection signal SEL1 and the second selection signal SEL2 have the same frequency, and an active period AP1 of the first selection signal SEL1 does not overlap with an active period AP2 of the second selection signal SEL2. The active period AP1 of the first selection signal SEL1 may be shorter than an inactive period IP1 of the first selection signal SEL1. Similarly, the active period AP2 of the second selection SEL2 may be shorter than its inactive period IP2 of the second selection SEL2.

When the switching transistors ST1, ST3, . . . , STm-1 are turned on in the active period AP1 of the first selection signal SEL1, the data signals DOUT1 to DOUTk are applied to the first data lines DL1, DL3, . . . , DLm-1. When the switching transistors ST2, ST4, . . . , STm are turned on in the active period AP2 of the second selection signal SEL2, the data signals DOUT1 to DOUTk are applied to the second data lines DL2, DL4, . . . , DLm.

When the scan signal S1 transmitted through the scan line SL1 from the scan driving circuit 130 is activated to a predetermined level (e.g., low level), the first pixels PXa11, PXa13, . . . , PXa1*m*-1 receive the data signals DOUT1 to DOUTk through the first data lines DL1, DL3, . . . , DLm-1. For example, when the data driving circuit 140 sequentially outputs the data signal DOUT1 through the channel CH1 in the order of Da1, Db1, Da2, Db2, Da3, Db3, . . . , Dan, and Dbn, the first data signal D1 applied to the first data line DL1 is Da1, Da2, Da3, . . . , and Dan, and the second data signal D2 applied to the first data line DL1 is Db1, Db2, Db3, . . . , and Dbn.

Therefore, the first pixels PXa11, PXa21, . . . , PXan1 connected to the first data line DL1 and sequentially arranged in the second direction DR2 receive the Da1, Da2, . . . , Dan as the first data signal D1, respectively. In addition, the second pixels PXb12, PXb22, . . . , PXbn2 connected to the second data line DL2 and sequentially arranged in the second direction DR2 receive the Db1, Db2, . . . , Dbn as the second data signal D2.

Since the first pixels and the second pixels, which are adjacent to each other in the second direction DR2, are commonly connected to one scan line, the number of the scan lines SL1 to SLn may be a half (½) of the number of the first pixels PXa11, PXa21, . . . , PXan1 and the second pixels PXb12, PXb22, . . . , PXbn2, which are arranged in the second direction DR2.

Since the pixel circuit 110 of the present disclosure requires ½ the number of scan lines in comparison with a pixel circuit in which one scan line is connected to one pixel, the area of the scan driving circuit 130 may be reduced.

As shown in FIG. 3, a blank time BT exists between the active period of the scan signal S1 and the active period of the scan signal S2 as an inactive period. Accordingly, a scan on time (SOT) corresponding to the active period of the scan signal S1 may be sufficiently long. For example, the scan on time (SOT) of each of the scan signals S1 to Sn may be equal to one horizontal period 1H. Since the scan on time (SOT) of each of the scan signals S1 to Sn may be sufficiently lengthened, a time required for write the first pixels PXa11, PXa21, . . . , PXan1 and the second pixels PXb12, PXb22, . . . , PXbn2 to write the data signals DOUT1 to DOUTk may be sufficient.

Figure 4:
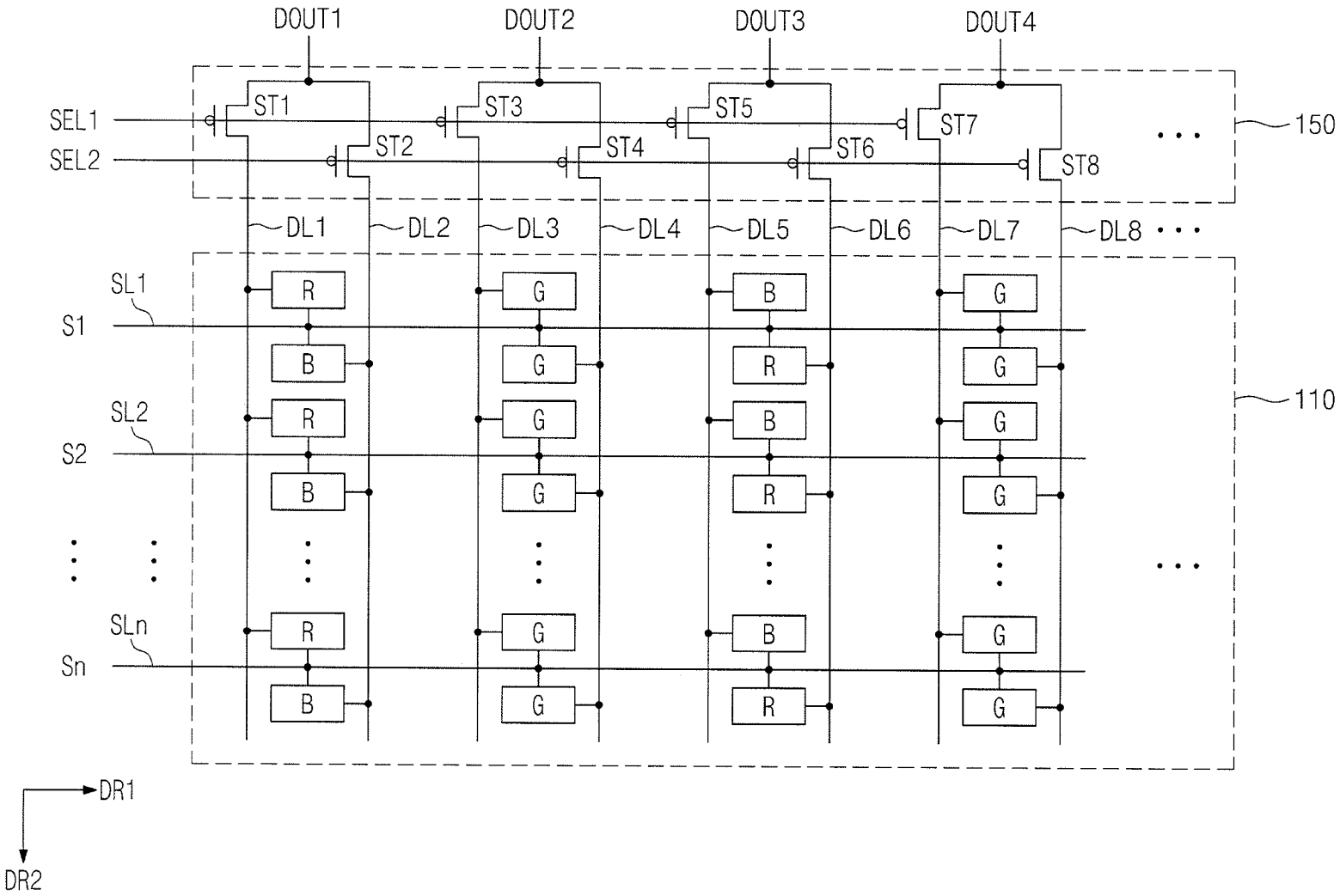
FIG. 4 illustrates an example of colors output by each pixel shown in FIG. 1.

FIG. 4 is a view showing an example of colors output by pixels shown in FIG. 1. Referring to FIG. 4, the first pixels PXa (refer to FIG. 1) connected to the data line DL1 and sequentially arranged in the second direction DR2 display a red (R) color. The second pixels PXb (refer to FIG. 1) connected to the data line DL2 and sequentially arranged in the second direction DR2 display a blue (B) color. The first pixels PXa and the second pixels PXb connected to the data line DL3 or the data line DL4 and sequentially arranged in the second direction DR2 display a green (G) color. Similarly, the first pixels PXa connected to the data line DL5 and sequentially arranged in the second direction DR2 display the red (R) color. The second pixels PXb connected to the data line DL6 and sequentially arranged in the second direction DR2 display the blue (B) color. The first pixels PXa and the second pixels PXb, which are connected to the data line DL7 or the data line DL8 and sequentially arranged in the second direction DR2 display the green (G) color, and so forth.

FIG. 4 shows the first pixels PXa and the second pixels PXb that display the red (R) color, the green (G) color, and the blue (B) color but may further include pixels that display a white (W) color.

Figure 5A:
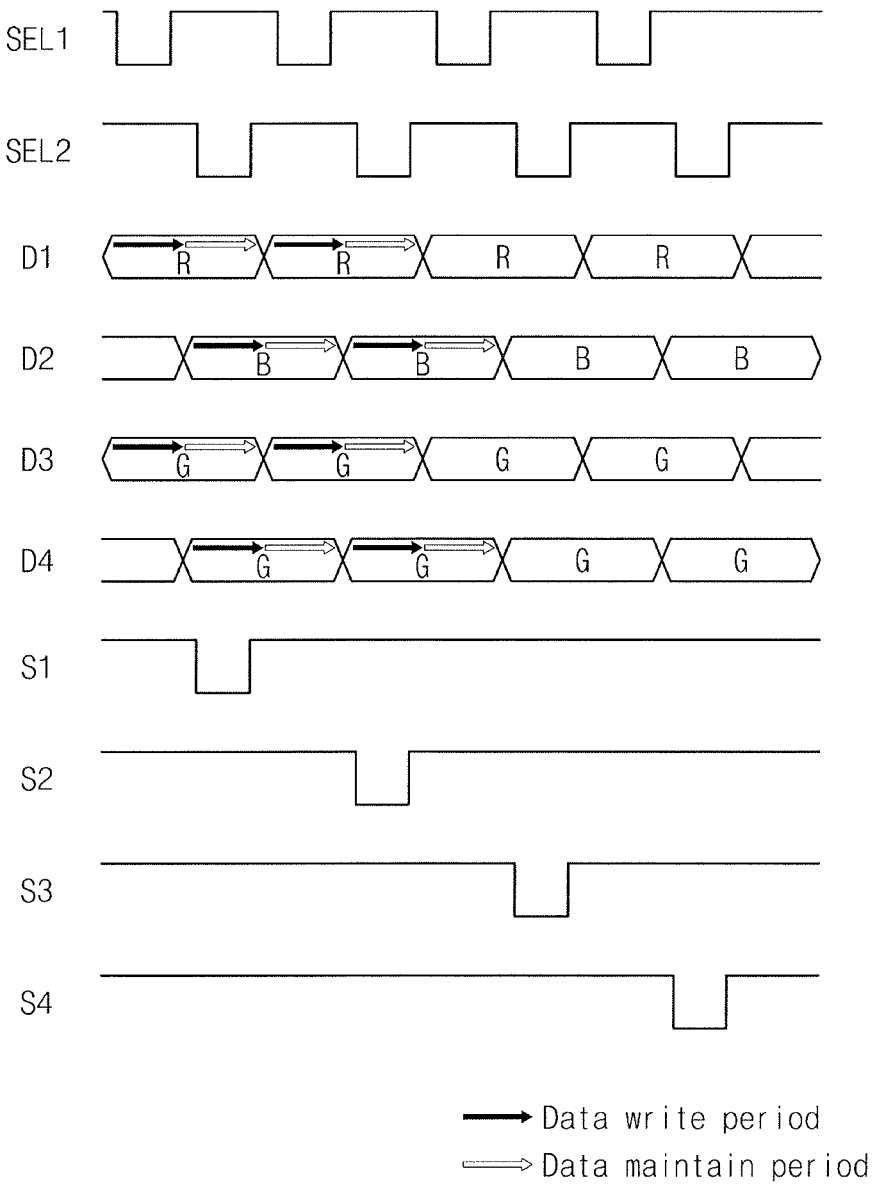
FIG. 5A illustrates a timing diagram showing an operation of a display device in an i-th frame.
Figure 5B:
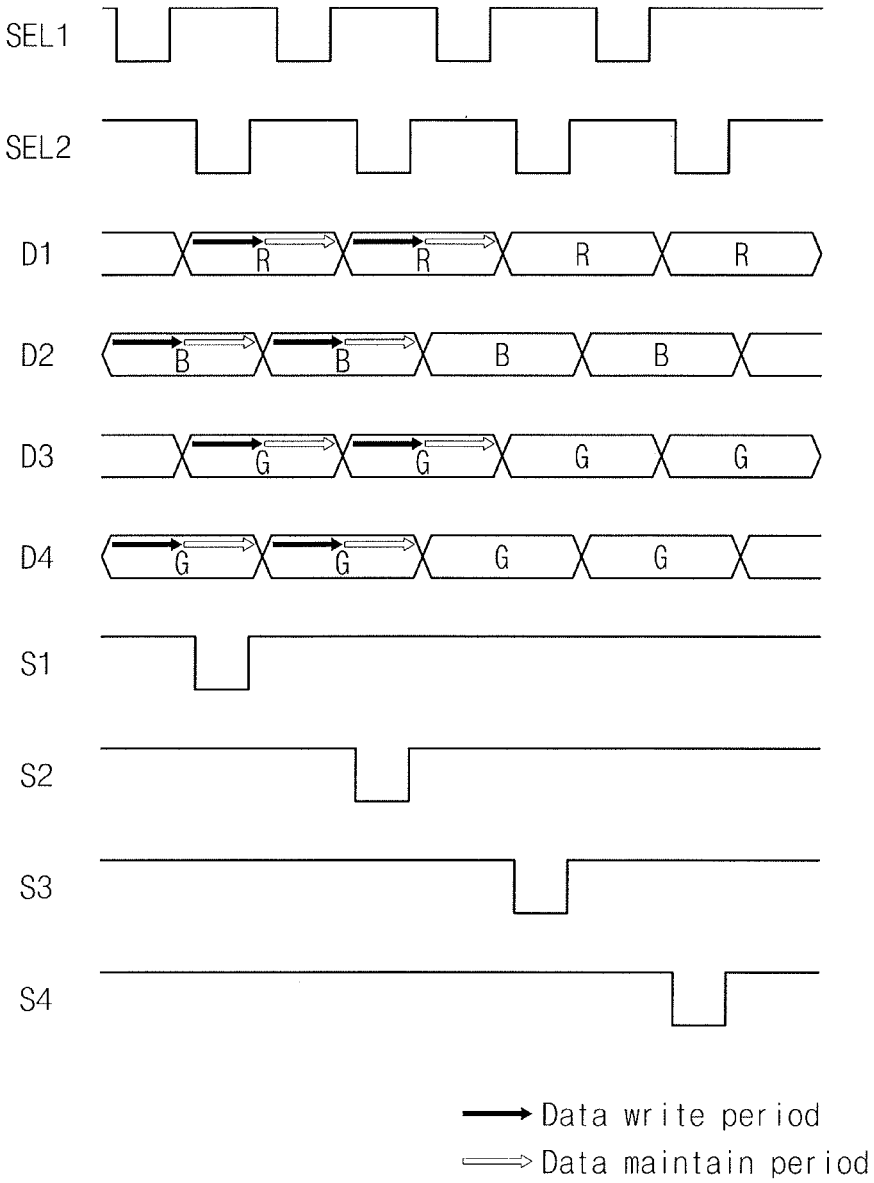
FIG. 5B illustrates a timing diagram showing an operation of a display device in an (i+1)th frame.

FIG. 5A is a timing diagram showing an operation of a display device in an i-th frame. FIG. 5B is a timing diagram showing an operation of a display device in an (i+1)th frame.

Referring to FIGS. 4 and 5A, the first pixels PXa connected to the data line DL1 that display the red (R) color and the first pixels PXa connected to the data line DL3 that display the green (G) color receive the data signals D1 and D3 in response to the scan signals SL1 to SLn during a data maintain period of the first data lines DL1 and DL3.

The second pixels PXb connected to the data line DL2 displaying the blue (B) color and the second pixels PXb connected to the data line DL4 displaying the green (G) color receive the data signals D2 and D4 in response to the scan signals SL1 to SLn during a data write period of the second data lines DL2 and DL4.

In particular, among the pixels displaying the green (G) color, the first pixels PXa connected to the data line DL3 and the second pixels PXb connected to the data line DL4 receive the data signals D3 and D4 during the data maintain period and the data write period, respectively. Although the data signals DOUT2 having the same grayscale level are applied to the data lines DL3 and DL4, there may be a slight difference between the data signal D3 in the data maintain period and the data signal D4 in the data write period due to a leakage current. That is, since the first pixels PXa arranged in odd-numbered rows receive the data signals D1, D3, . . . , Dm-1 during the data maintain period and the second pixels PXb arranged in even-numbered rows receive the data signals D2, D4, . . . , Dm in the data write period, a brightness difference appearing as a horizontal line may be perceived by the user.

As shown in FIG. 5A, in the i-th frame, the first pixels PXa arranged in the odd-numbered rows receive the data signal D1, D3, . . . , Dm-1 during the data maintain period and the second pixels PXb arranged in the even-numbered rows receive the data signals D2, D4, . . . , Dm during the data write period. As shown in FIG. 5B, in the (i+1)th frame, the first pixels PXa arranged in the odd-numbered rows receive the data signal D1, D3, . . . , Dm-1 during the data maintain period and the second pixels PXb arranged in the even-numbered rows receive the data signals D2, D4, . . . , Dm during the data write period.

As described above, the first pixels PXa and the second pixels PXb alternately receive the data signals D1 to Dm during the data maintain period and the data write period at every frame, the brightness difference appearing as the horizontal line may be reduced or prevented.

Figure 6:
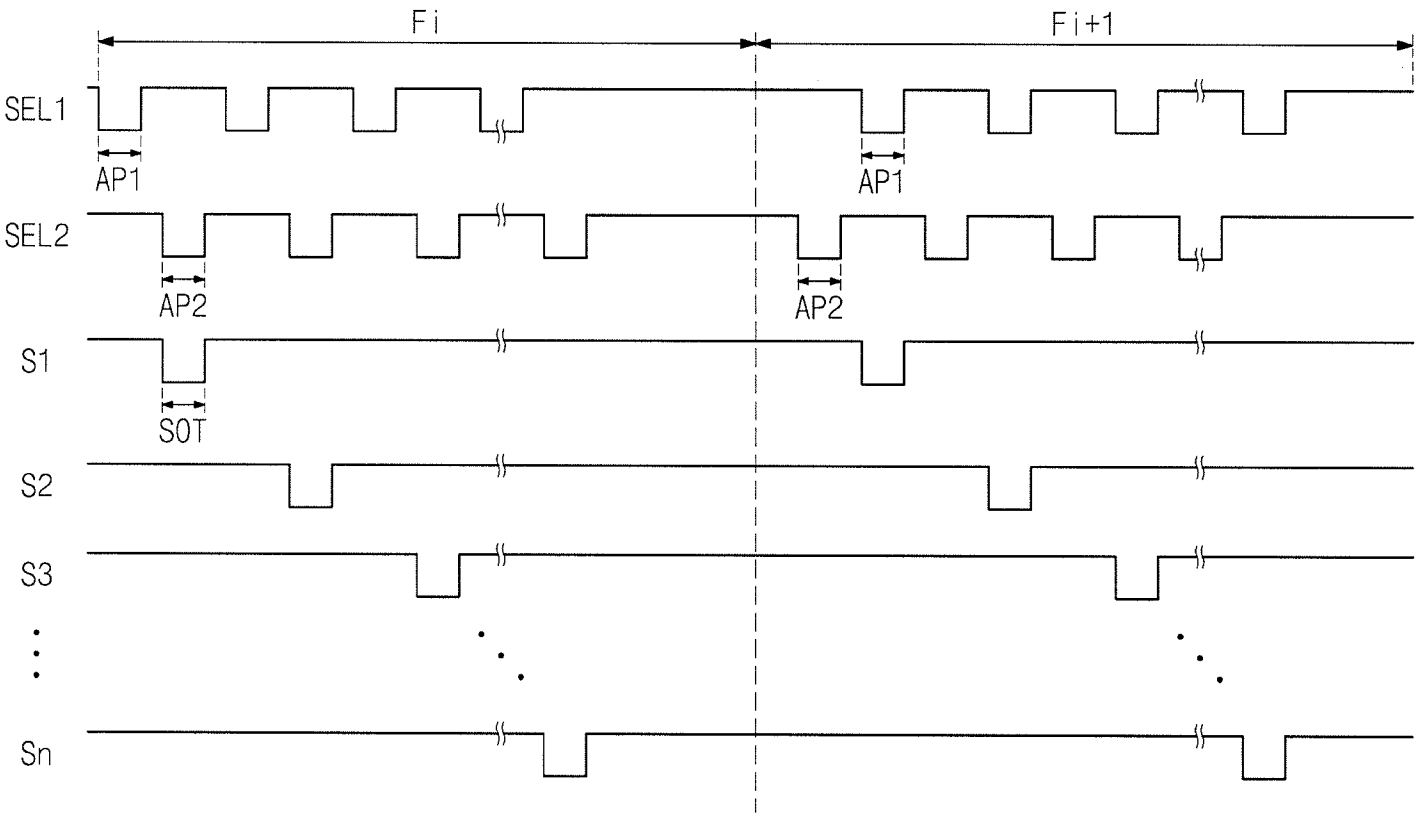
FIG. 6 illustrates a waveform diagram showing a variation of a first selection signal and a second selection signal in consecutive frames.

FIG. 6 is a waveform diagram showing a variation of the first selection signal SEL1 and the second selection signal SEL2 in consecutive frames. Referring to FIG. 6, when the i-th frame Fi starts, the first selection signal SEL1 is activated to a low level, and then the second selection signal SEL2 is activated to the low level.

In the i-th frame Fi, the scan on time SOT of each of the scan signals S1 to Sn overlaps the active period AP2 of the second selection signal SEL2. In the exemplary embodiment, the scan on time SOT of each of the scan signal S1 to Sn may be equal to or longer than the active period AP2 of the second selection signal SEL2.

When the (i+1)th frame Fi+1 that is temporally continuous from the first frame Fi starts, the second selection signal SEL2 is activated to the low level, and then the first selection signal SEL1 is activated to the low level.

The scan on time SOT of each of the scan signals S1 to Sn overlaps the active period AP1 of the first selection signal SEL1 in the (i+1)th frame Fi+1. In the exemplary embodiment, the scan on time SOT of each of the scan signal S1 to Sn may be equal to or longer than the active period AP1 of the first selection signal SEL1.

Figure 7:
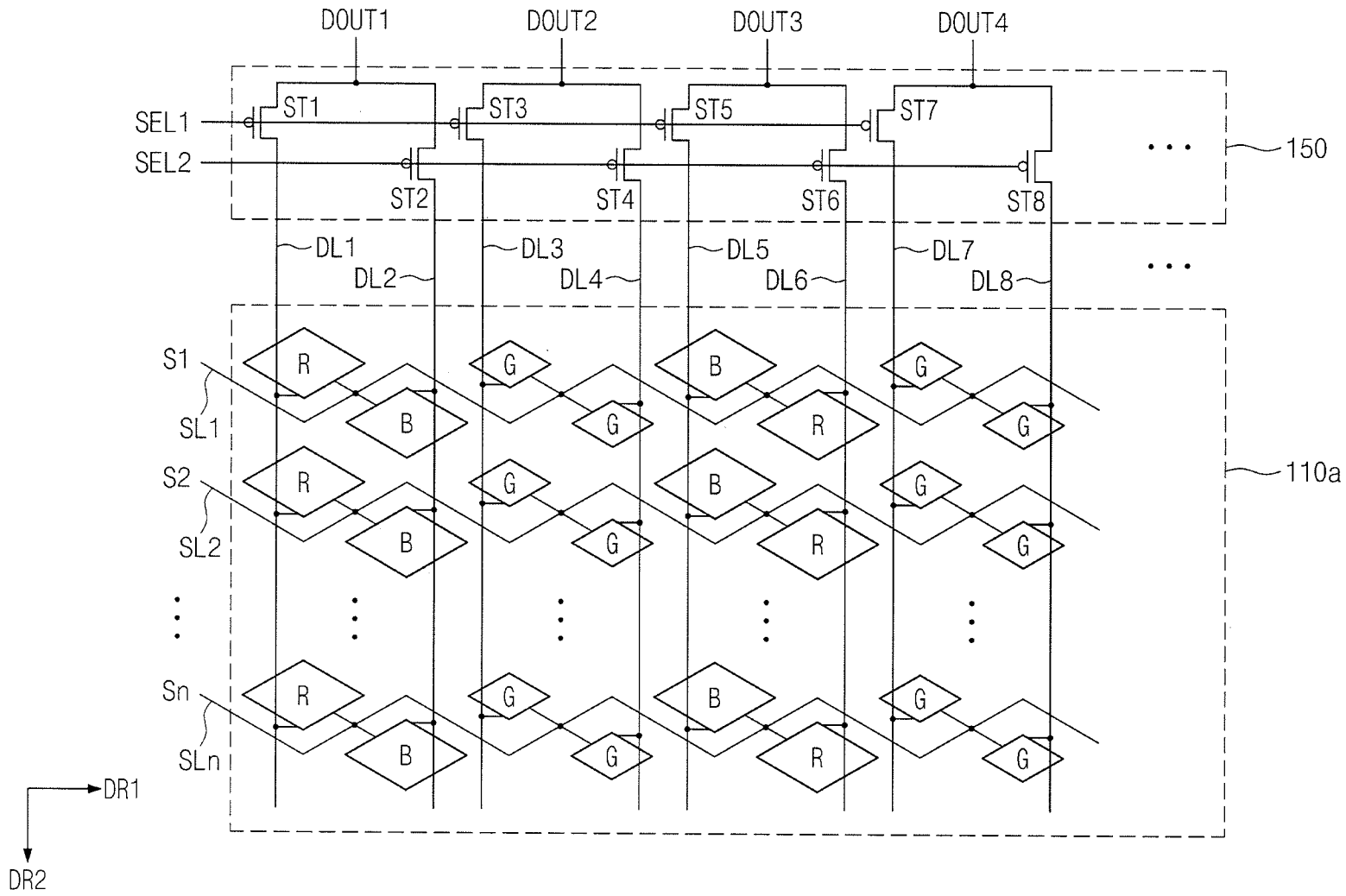
FIG. 7 illustrates an example of colors output by each pixel shown in FIG. 1 and a pixel layout.

FIG. 7 is a view of an example of a layout of pixels shown in FIG. 1. The pixels of the pixel circuit 110*a* shown in FIG. 7 are connected to the data lines DL1 to DLm in the same manner as the pixels PXa and PXb of the pixel circuit 110 shown in FIGS. 1 and 4. That is, the first pixels PXa (refer to FIG. 1) connected to the data line DL1 and sequentially arranged in the second direction DR2 display the red (R) color. The second pixels PXb (refer to FIG. 1) connected to the data line DL2 and sequentially arranged in the second direction DR2 display the blue (B) color. The first pixels PXa and the second pixels PXb connected to the data line DL3 or the data line DL4 and sequentially arranged in the second direction DR2 display the green (G) color. Similarly, the first pixels PXa connected to the data line DL5 and sequentially arranged in the second direction DR2 display the red (R) color. The second pixels PXb (refer to FIG. 1) connected to the data line DL6 and sequentially arranged in the second direction DR2 display the blue (B) color. The first pixels PXa and the second pixels PXb connected to the data line DL7 or the data line DL8 and sequentially arranged in the second direction DR2 display the green (G) color.

The pixels of the pixel circuit 110*a* shown in FIG. 7 overlap with the data lines DL1 to DLm and do not overlap with the source lines SL1 to SLn when viewed in a plan view, however, they should not be limited thereto or thereby.

Each of the pixels of the pixel circuit 110*a* shown in FIG. 7 has a lozenge shape and the pixels of the pixel circuit 110*a* shown in FIG. 7 are arranged in a zigzag form. In implementations, the pixels of the pixel circuit 110*a* may have various shapes and may be arranged in various ways. In addition, each of the pixels may have a lozenge shape with rounded corners.

In the exemplary embodiment shown in FIG. 7, an area of the pixels displaying the red (R) and blue (B) colors is larger than an area of the pixels displaying the green (G) color. In an implementation, the pixels of the pixel circuit 110*a* may have the same area or different areas for each color.

In the exemplary embodiment shown in FIG. 7, the scan lines SL1 to SLn extend in the first direction DR1 and have a zigzag form. In an implementation, the scan lines SL1 to SLn may be in a straight line in the first direction to be substantially parallel to each other and may partially overlap with the pixels.

FIG. 7 show the first pixels PXa and the second pixels PXb that display the red (R), green (G), and blue (B) colors as a representative example. In an implementation, the first pixels PXa and the second pixels PXb may further display white W in addition to the red (R), green (G), and blue (B) colors.

By way of summation and review, the present disclosure provides a display device in which an area of a non-display area is reduced and a method of driving the display device in which the area of the non-display area is reduced.

According to the above, the display device includes the data output circuit in which the number of ICs of the data driving circuit may be reduced. In particular, since the first pixel arranged in a first row and the second pixel arranged in a second row are commonly connected to one scan line, the number of the scan lines required by the display device may be reduced to half. Thus, the circuit area of the scan circuit may be reduced, thereby reducing the non-display area.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device comprising:

a pixel circuit including a first pixel and a second pixel, the first pixel being connected to a first data line and a scan line, and the second pixel being connected to a second data line and the scan line;

a scan driving circuit to output a scan signal to drive the scan line;

a data driving circuit to output a data signal;

a data output circuit to apply the data signal to the first data line in response to a first selection signal, and apply the data signal to the second data line in response to a second selection signal; and a driving controller to control the scan driving circuit and the data driving circuit and to output the first selection signal and the second selection signal, wherein an active period of the first selection signal does not overlap an active period of the second selection signal, and a scan on time of the scan signal overlaps only one of the active period of the first selection signal and the active period of the second selection signal, wherein, when a first frame starts, the first selection signal is activated and then the second selection signal is activated with a first scan signal activated before any second scan signal is activated, and the scan on time of the scan signal overlaps the active period of the second selection signal, and when a second frame consecutive from the first frame starts, the second selection signal is activated and then the first selection signal is activated with the first scan signal activated before any second scan signal is activated, and the scan on time of the scan signal overlaps the active period of the first selection signal.

2. The display device as claimed in claim 1, wherein:

the scan line extends in a first direction, the first data line and the second data line extend in a second direction crossing the first direction and are spaced apart from each other, and the first pixel and the second pixel are sequentially arranged in the second direction.

3. The display device as claimed in claim 2, wherein:

the first data line is adjacent to a first side of the first pixel and the second pixel, and the second data line is adjacent to a second side of the first pixel and the second pixel.

4. The display device as claimed in claim 2, wherein:

the first pixel in a first column is a red pixel, the second pixel in the first column is a blue pixel, and first and second pixels in a second column adjacent to the first column is a green pixel.

5. The display device as claimed in claim 1, wherein the scan on time of the scan signal is substantially equal to one horizontal period.

6. The display device as claimed in claim 1, wherein:

the active period of the first selection signal is shorter than an inactive period of the first selection signal, and the active period of the second selection signal is shorter than an inactive period of the second selection signal.

7. The display device as claimed in claim 1, wherein the data output circuit includes:

a first switching transistor to apply the data signal to the first data line in response to the first selection signal; and a second switching transistor to apply the data signal to the second data line in response to the second selection signal.

8. A display device, comprising:

a pixel circuit including a first pixel connected to a first data line and a scan line and a second pixel connected to a second data line and the scan line;

a scan driving circuit to output a scan signal to drive the scan line;

a data driving circuit to output a data signal;

a data output circuit to apply the data signal to the first data line in response to a first selection signal, and apply the data signal to the second data line in response to a second selection signal; and a driving controller to control the scan driving circuit and the data driving circuit and output the first selection signal and the second selection signal, wherein the driving controller sequentially activates the first selection signal and the second selection signal, when a first frame starts, the first selection signal is activated and then the second selection signal is activated with a first scan signal activated before any second scan signal is activated, and the scan on time of the scan signal overlaps an active period of the second selection signal, when a second frame consecutive from the first frame starts, the second selection signal is activated and then the first selection signal is activated with the first scan signal activated before any second scan signal is activated, and the scan on time of the scan signal overlaps an active period of the first selection signal, the scan line extends in a first direction, the first data line and the second data line extend in a second direction crossing the first direction, and the first pixel and the second pixel are alternately arranged in the second direction.

9. The display device as claimed in claim 8, wherein:

the first data line is adjacent to a first side of the first pixel and the second pixel, and the second data line is arranged adjacent to a second side of the first pixel and the second pixel.

10. The display device as claimed in claim 8, wherein:

the first pixel arranged in a first column is a red pixel, a second pixel arranged in the first column is a blue pixel, and each of the first and second pixels arranged in a second column adjacent to the first column is a green pixel.

11. The display device as claimed in claim 8, wherein a scan on time of the scan signal is substantially equal to one horizontal period.

12. The display device as claimed in claim 8, wherein the data output circuit includes:

a first switching transistor to apply the data signal to the first data line in response to the first selection signal; and a second switching transistor to apply the data signal to the second data line in response to the second selection signal.

13. A method of driving a display device that includes a first pixel connected to a first data line and a scan line and a second pixel connected to a second data line and the scan line, the method comprising:

outputting a first data signal to the first data line in response to a first selection signal;

outputting a second data signal to the second data line in response to a second selection signal; and applying a scan signal to the scan line, wherein an active period of the first selection signal does not overlap an active period of the second selection signal, wherein when a first frame starts, the first selection signal is activated and then the second selection signal is activated with a first scan signal activated before any second scan signal is activated, and the scan on time of the scan signal overlaps the active period of the second selection signal, and when a second frame consecutive from the first frame starts, the second selection signal is activated and then the first selection signal is activated with the first scan signal activated before any second scan signal is activated, and the scan on time of the scan signal overlaps the active period of the first selection signal.

14. The method as claimed in claim 13, wherein:

the scan line extends in a first direction, the first data line and the second data line extend in a second direction crossing the first direction and are arranged spaced apart from each other, and the first pixel and the second pixel are sequentially arranged in the second direction.

15. The method as claimed in claim 13, wherein the scan on time of the scan signal is substantially equal to one horizontal period.

* * * * *